US011075480B2

(12) United States Patent
Misaiji et al.

(10) Patent No.: US 11,075,480 B2
(45) Date of Patent: Jul. 27, 2021

(54) CONNECTOR STRUCTURE

(71) Applicants: YAZAKI CORPORATION, Tokyo (JP); TOYOTA JIDOSHA KABUSHIKI KAISHA, Toyota (JP)

(72) Inventors: Takeshi Misaiji, Seto (JP); Hiroshi Kobayashi, Okazaki (JP); Masayuki Saito, Makinohara (JP)

(73) Assignees: YAZAKI CORPORATION, Tokyo (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/776,940

(22) Filed: Jan. 30, 2020

(65) Prior Publication Data

US 2020/0251848 A1 Aug. 6, 2020

(30) Foreign Application Priority Data

Feb. 4, 2019 (JP) ..... JP2019-017835

(51) Int. Cl.
*H01R 13/502* (2006.01)
*H01R 13/627* (2006.01)

(52) U.S. Cl.
CPC ..... *H01R 13/5025* (2013.01); *H01R 13/6272* (2013.01)

(58) Field of Classification Search
CPC ..... H01R 13/5025; H01R 13/6272
See application file for complete search history.

(56) References Cited

U.S. PATENT DOCUMENTS

| | | | | |
|---|---|---|---|---|
| 7,104,840 | B2 | 9/2006 | Murakami | |
| 7,214,080 | B2 * | 5/2007 | Ichio | H01R 13/6272 439/246 |
| 2006/0009058 | A1 | 1/2006 | Nagano et al. | |
| 2007/0059970 | A1 | 3/2007 | Ichio et al. | |

FOREIGN PATENT DOCUMENTS

| | | | |
|---|---|---|---|
| CN | 1933252 | A | 3/2007 |
| JP | 2005-174813 | A | 6/2005 |
| JP | 2006-24456 | A | 1/2006 |
| JP | 2007-80690 | A | 3/2007 |

* cited by examiner

*Primary Examiner* — Ross N Gushi
(74) *Attorney, Agent, or Firm* — Sughrue Mion, PLLC

(57) ABSTRACT

A connector structure includes a hood formed in a housing and having a bottomed tubular shape, a mating hood formed in a mating housing and fitted inside the hood, a plate spring member made of metal and accommodated in a bottom of the hood, a playing regulating member, a mating hood tip end inclined surface formed at a tip end of the mating hood in a fitting direction and inclined to a tube inner side or a tube outer side, and a playing regulating protrusion. The playing regulating member is provided in an opposite side against the bottom with the plate spring member interposed therebetween and is urged by the plate spring member in a direction opposite to a fitting direction against the mating hood.

3 Claims, 16 Drawing Sheets

CONNECTOR STRUCTURE

CROSS REFERENCE TO RELATED APPLICATIONS

This application claims priority from Japanese Patent Application No. 2019-017835 filed on Feb. 4, 2019, the entire contents of which are incorporated herein by reference.

BACKGROUND OF THE INVENTION

Field of the Invention

The present invention relates to a connector structure.

Description of Related Art

There has been known a technique for providing a connector structure without rattling (for example, Patent Literature 1). As shown in FIG. 16, the connector structure includes a connector 503 including a hood 501 and a mating connector 507 including a mating hood 505. In the mating connector 507, a packing 509 that is an elastic member made of a resin is disposed inside the mating hood 505. When the connectors are fitted with each other, the hood 501 of the connector 503 is inserted into the mating hood 505 of the mating connector 507, and a tip end of the hood 501 presses a protruding piece 511 of the packing 509 to prevent rattling between the connector 503 and the mating connector 507 in a fitting axial direction.

[Patent Literature 1] JP-A-2005-174813

In the related art connector structure, the packing 509 is accommodated in a fitting space of the mating hood 505, and the hood 501 is also inserted into the fitting space, so that the fitting space is effectively used.

However, since the packing 509 is the elastic member made of the resin, there is a concern that an elastic repulsive force is reduced due to deterioration due to long-term use, and an effect of preventing the rattling is reduced. As a result, due to vibration during traveling of a vehicle or the like, electrical connection reliability may be reduced due to fine sliding wear between a male tab 513 and a contact spring 515 of a female terminal.

SUMMARY

One or more embodiments provide a connector structure capable of obtaining a stable vibration resistant effect even after aging.

In an aspect (1), one or more embodiments provide a connector structure including a hood formed in a housing and having a bottomed tubular shape, a mating hood formed in a mating housing and fitted inside the hood, a plate spring member made of metal and accommodated in a bottom of the hood, a playing regulating member, a mating hood tip end inclined surface formed at a tip end of the mating hood in a fitting direction and inclined to a tube inner side or a tube outer side, and a playing regulating protrusion. The playing regulating member is provided in an opposite side against the bottom with the plate spring member interposed therebetween and is urged by the plate spring member in a direction opposite to a fitting direction against the mating hood. The playing regulating protrusion is provided on the playing regulating member and has a regulating member inclined surface which is configured to be abutted against the mating hood tip end inclined surface in a state that the housing and the mating housing are fitted with each other.

According to the aspect (1), the plate spring member made of metal is provided at the bottom of the hood. The playing regulating member is provided in an opposite side against the bottom with the plate spring member interposed therebetween. The playing regulating member is urged by the plate spring member in a direction opposite to a fitting direction of the mating hood. The playing regulating member is provided with the regulating member inclined surface. Immediately before the completion of the fitting, the regulating member inclined surface is pressed against the mating hood tip end inclined surface formed at the tip end in the fitting direction of the mating hood. The playing regulating member including the regulating member inclined surface pressed against the mating hood tip end inclined surface compresses and deforms the plate spring member against a spring force (elastic restoring force). When an insertion force for the fitting is released, the mating housing is urged by the elastic restoring force of the plate spring member and pushed back in the direction opposite to the fitting direction.

Therefore, in the mating housing pushed back by the elastic restoring force of the plate spring member, a mating locking surface of a lock projection provided on the mating housing came into close contact with an arm side locking surface of a lock arm provided on the housing, and a clearance in a lock mechanism can be eliminated. That is, the rattling due to the clearance in the lock mechanism that fits and locks both of the housings is reduced. Accordingly, in the connector structure according to the present configuration, in the fitted and locked state of the housings, a movement between the mating locking surface of the lock projection and the arm side locking surface of the lock arm in the approaching and separating directions due to the clearance in the lock mechanism becomes impossible. As a result, in the connector structure according to the present configuration, even when vibration occurs during traveling or the like of the vehicle, fine sliding between a terminal accommodated in the housing and a mating terminal accommodated in the mating housing can be prevented. In the connector structure according to the present configuration, the plate spring member that pushes back the mating housing so as to eliminate the clearance in the lock mechanism is made of a metal elastic member. Therefore, the plate spring member is less likely to creep due to aging like an elastic member made of rubber or resin. That is, a push-back force acting on the mating housing can be maintained for a long period of time. Therefore, the plate spring member can maintain an elastic repulsive force of the spring portion even in long-term use, and can prevent the rattling in the fitting direction between the housing and the mating housing.

In addition, the mating hood tip end inclined surface of the mating hood and the regulating member inclined surface of the playing regulating protrusion which are in the abutting state may displace in directions inward and outward the tube by receiving the elastic restoring force of the plate spring member.

For example, when the mating hood tip end inclined surface facing the tube inner side is formed at the tip end of the mating hood, and the regulating member inclined surface facing the tube outer side is provided on the playing regulating protrusion, by receiving the elastic restoring force of the plate spring member, the tip end of the mating hood displaces toward the tube outer side, and the playing regulating protrusion displaces toward the tube inner side.

Further, for example, when the mating hood tip end inclined surface facing the tube outer side is formed at the tip end of the mating hood, and the regulating member inclined surface facing the tube inner side is provided on the playing regulating protrusion, by receiving the elastic restoring force of the plate spring member, the tip end of the mating hood displaces toward the tube inner side, and the playing regulating protrusion displaces toward the tube outer side.

The displacement prevents rattling in directions orthogonal to the tubular center axis due to the clearance between the housing and the mating housing.

Therefore, according to the connector structure of the present configuration, abrasion powder generated by the fine sliding wear between the terminal and the mating terminal can be prevented from being an oxide insulator, so that contact reliability between the terminal and the mating terminal can be prevented from being reduced. Therefore, it is possible to maintain good contact reliability over a long period of time.

In an aspect (2), at least one of the playing regulating protrusion is provided on each of the playing regulating member in an upper-lower direction and a left-right direction that are orthogonal to each other, and is orthogonal to a tubular center axis of the hood.

According to the aspect (2), at least four playing regulating protrusions provided on the playing regulating member are separately provided on four sides including upper and lower sides of the playing regulating member that sandwich the tubular center axis of the hood vertically, and left and right sides of the playing regulating member that sandwich the tubular center axis of the hood on the left and right. Incidentally, a pair of the playing regulating protrusions may be provided on one of the four sides (for example, an upper side of the playing regulating member) with the tubular center axis interposed therebetween. In this case, a total of five playing regulating protrusions are provided. As described above, in the connector structure according to the present configuration, the playing regulating protrusions provided on the playing regulating member are arranged radially in four directions sandwiching the tubular center axis in the upper-lower and left-right directions. Therefore, the tip end of the mating hood abuts against the playing regulating member substantially uniformly in a radial direction around the tubular center axis. As a result, an urging force of the plate spring member acting on the tip end of the mating hood via the playing regulating member is substantially uniform in the radial direction around the tubular center axis. As a result, the playing regulating member can maintain a high degree of parallelism with the bottom even when the plate spring member is pressed and moved or when the mating hood is pushed back. Therefore, in the connector structure according to the present configuration, it is possible to prevent the playing regulating member from being inclined with respect to the bottom and causing the rattling reducing action to be uneven in the radial direction.

In an aspect (3), a spring excessive displacement preventing projection that abuts against the bottom is formed on the playing regulating member.

According to the aspect (3), the playing regulating member includes the spring excessive displacement preventing projection protruding toward the bottom. When the connector and the mating connector are fitted, the playing regulating member presses the plate spring member toward the bottom when the regulating member inclined surface is pressed against the mating hood tip end inclined surface. The spring portion provided on the plate spring member is compressed and deformed by this pressing. In a process of compressing and deforming the spring portion of the plate spring member, the spring excessive displacement preventing projection abuts against the bottom before displacement exceeding an elastic limit is applied. Accordingly, the spring portion of the plate spring member is regulated from further displacement. As a result, in the connector structure according to the present configuration, the spring portion of the plate spring member can be prevented from being excessively deformed beyond the elastic limit and plastically deformed, so that a stable rattling reducing action can be maintained.

According to one or more embodiments, a stable vibration resistant effect can be obtained even after aging.

The present invention is briefly described as above. Further, details of the present invention will be clarified by reading a mode for carrying out the invention described below with reference to the accompanying drawings.

BRIEF DESCRIPTION OF THE DRAWINGS

FIG. 5A is a plan sectional view of a hood to which the plate spring member is mounted. FIG. 5B is a plan sectional view of the hood to which the plate spring member and the playing regulating member are mounted.

DETAILED DESCRIPTION

Embodiments of the present invention will be described below with reference to the drawings.

Figure 1:
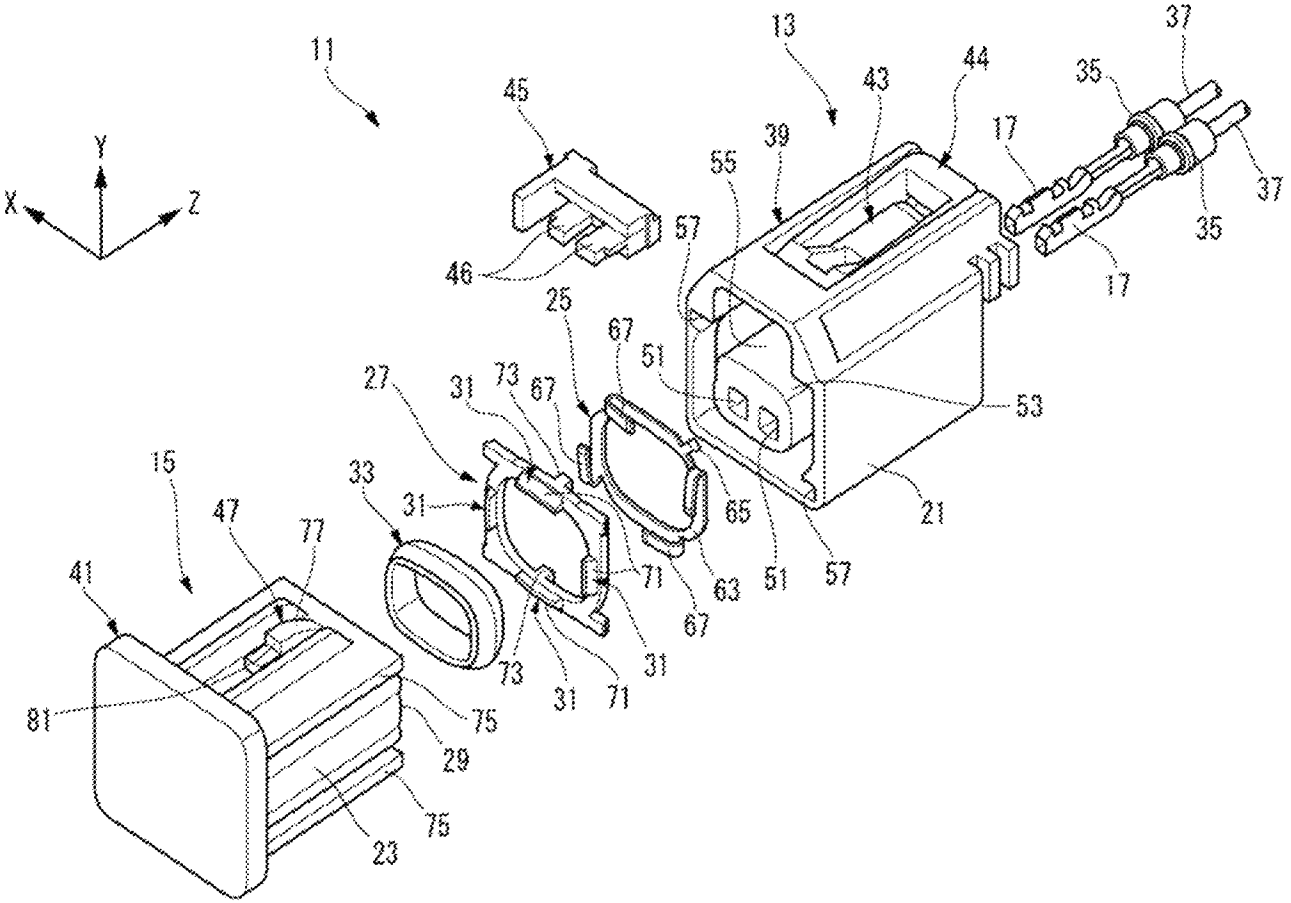
FIG. 1 is an exploded perspective view of a high vibration resistant connector including a connector structure according to a first embodiment of the present invention.

FIG. 1 is an exploded perspective view of a high vibration resistant connector 11 including a connector structure according to a first embodiment of the present invention. In the present specification, X, Y and Z directions follow directions of arrows shown in FIG. 1.

The connector structure according to the first embodiment is applied to the high vibration resistant connector 11.

The high vibration resistant connector 11 is configured with a connector 13 and a mating connector 15 being fitted together. In the first embodiment, the connector 13 is a female connector. The mating connector 15 is a male connector. The mating connector 15 can be formed as a part of an auxiliary machine, for example. The connector 13 accommodates, for example, two female terminals 17 formed in a box shape. The mating connector 15 accommodates, for example, two male mating terminals 19 (see FIG. 8) formed in a tab shape. Incidentally, a shape and the number of the terminals of the connector structure are not limited thereto.

The connector structure according to the first embodiment mainly includes a hood 21 of the connector 13, a mating hood 23 of the mating connector 15, a plate spring member 25, a playing regulating member 27, a mating hood tip end inclined surface 29 of the mating connector 15, and a playing regulating protrusion 31 of the playing regulating member 27.

In addition, the connector structure according to the first embodiment includes a packing 33, rubber plugs 35, electric wires 37, a housing 39 of the connector 13, a mating housing 41 of the mating connector 15, a lock arm 43, a side spacer 45, and a lock projection 47.

Figure 2:
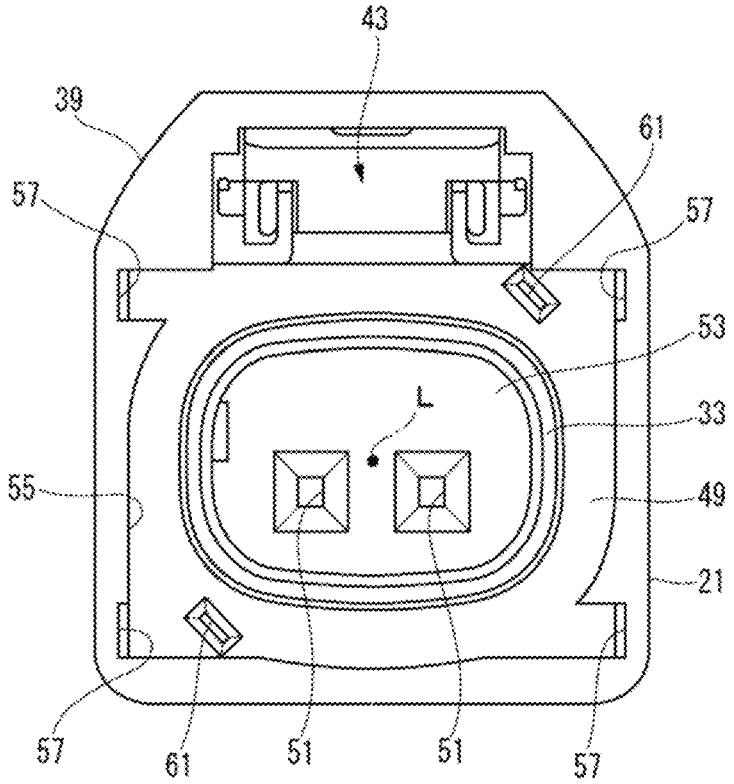
FIG. 2 is a front view of the connector shown in FIG. 1.

FIG. 2 is a front view of the connector 13 shown in FIG. 1.

The hood 21 of the connector 13 is formed integrally with the housing 39 made of an insulating resin, and is formed in a substantially rectangular bottomed tubular shape. A bottom 49 is a back wall of the housing 39. An inner tube portion 53 formed with terminal receiving ports 51 protrudes coaxially inside the hood 21. An annular fitting space 55 is formed between the inner tube portion 53 and the hood 21. The mating hood 23 of the mating connector 15 is fitted into the fitting space 55. In the fitting space 55, grooves 57 extending along a tubular center axis L are formed on an upper and lower side with the inner tube portion 53 sandwiched therebetween. Each of the grooves 57 is provided with a locked protruding portion 59 (see FIGS. 5A and 5B). A pair of press-fitting holes 61 is formed on both sides of a line segment connecting a pair of diagonal corners of the bottom 49 of the fitting space 55.

Figure 3:
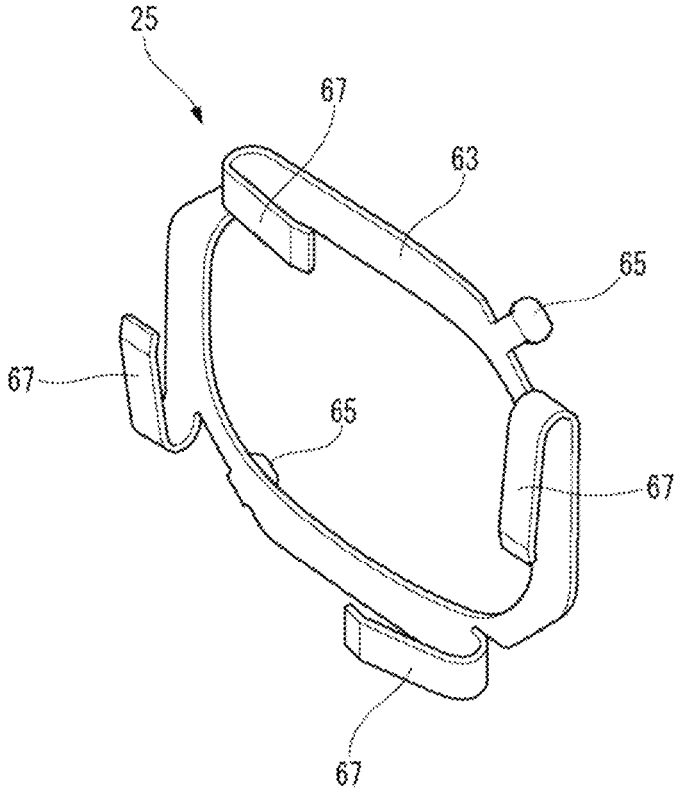
FIG. 3 is a perspective view of a plate spring member shown in FIG. 1.

FIG. 3 is a perspective view of the plate spring member 25 shown in FIG. 1.

The plate spring member 25 made of metal is accommodated in the bottom 49 of the hood 21. The plate spring member 25 includes a plate spring main body portion 63. The plate spring member 25 is formed in a square frame shape obtained by punching a metal plate parallel to the bottom 49 into a substantially rectangular shape. A pair of press-fitting projections 65 protrudes from a surface of the plate spring main body portion 63 facing the bottom 49 so as to correspond to the press-fitting holes 61. Four spring portions 67 are integrally formed on a surface of the plate spring main body portion 63 on a side not facing the bottom 49. The spring portions 67 are formed by bending so as to overlap along sides of the plate spring main body portion 63, respectively. Each of the spring portions 67 is formed as a plate spring with a bent tip end as a free end.

Figure 4:
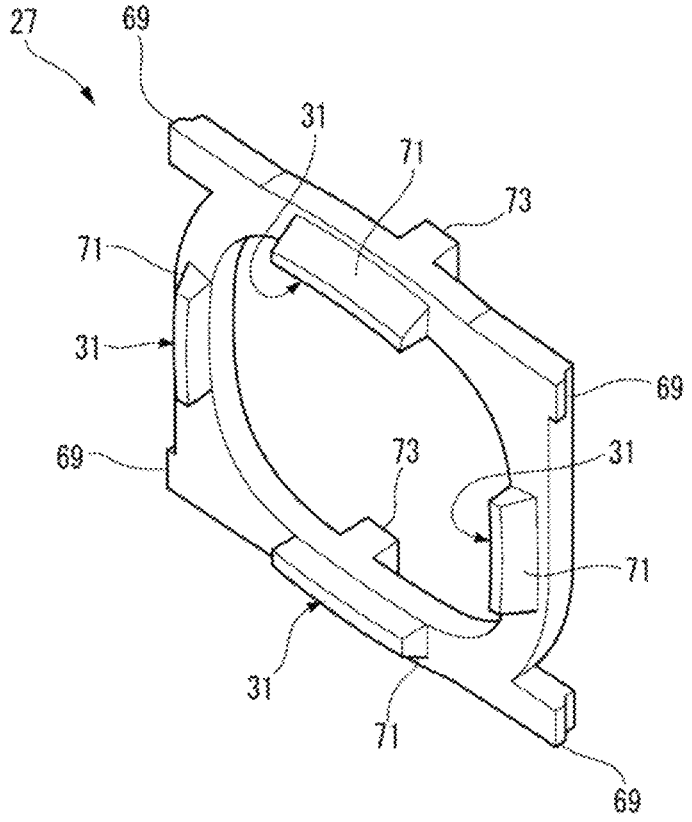
FIG. 4 is a perspective view of a playing regulating member shown in FIG. 1.

FIG. 4 is a perspective view of the playing regulating member 27 shown in FIG. 1.

The playing regulating member 27 is formed of an insulating resin material. The playing regulating member 27 is formed in a square frame shape substantially similar to the plate spring main body portion 63. The playing regulating member 27 is mounted facing the bottom 49 with the plate spring member 25 interposed therebetween. The playing regulating member 27 is urged in a direction opposite to a fitting direction (Z direction) of the mating hood 23 by the spring portions 67 of the plate spring member 25. On both sides of an upper side portion and both sides of a lower side portion of the playing regulating member 27, protruding portions 69 protruding in extending directions of the side portions thereof are formed. The protruding portions 69 are respectively locked to the locked protruding portions 59 provided in the grooves 57 described above. As a result, the playing regulating member 27 is movable along a fitting direction (Z direction) of the mating hood 23, and is regulated from falling-off from the hood 21 of the connector 13.

A plurality of playing regulating protrusions 31 is integrally formed on a surface of the playing regulating member 27 on a side not facing the bottom 49. The playing regulating protrusion 31 is formed with a regulating member inclined surface 71. The regulating member inclined surface 71 abuts against the mating hood tip end inclined surface 29 of the mating hood 23 to be described later when the housing 39 and the mating housing 41 are fitted with each other.

The regulating member inclined surface 71 is inclined either inward or outward the tube. In the first embodiment, the regulating member inclined surface 71 is inclined toward a tube outer side. That is, the regulating member inclined surface 71 is formed as an inclined surface facing the tube outer side. "Facing the tube outer side" refers to facing the outside in a radial direction of the tube around the tubular center axis L in the Z direction. Further, "facing the tube inner side" refers to facing the inside in the radial direction of the tube around the tubular center axis L in the Z direction.

In the connector structure according to the first embodiment, at least one playing regulating protrusion 31 is provided on the playing regulating member 27 in an upper-lower direction (Y direction) and a left-right direction (X direction) that are respectively orthogonal to the tubular center axis L of the hood 21, and are orthogonal to each other. In the connector structure according to the first embodiment, the playing regulating protrusion 31 is provided with a total of four, each one at the approximate center of each side portion of the playing regulating member 27 formed in a square frame shape. As described above, in the connector structure according to the first embodiment, the playing regulating protrusions 31 are arranged radially in four directions sandwiching the tubular center axis L in the upper-lower and left-right directions.

A pair of spring excessive displacement preventing projections 73 protrudes from a surface of the playing regulating member 27 facing the bottom 49 at an upper side portion and a lower side portion. When the spring portion 67 is displaced by a certain amount, a protruding tip end of the spring excessive displacement preventing projection 73 abuts against the bottom 49.

Figure 5B:
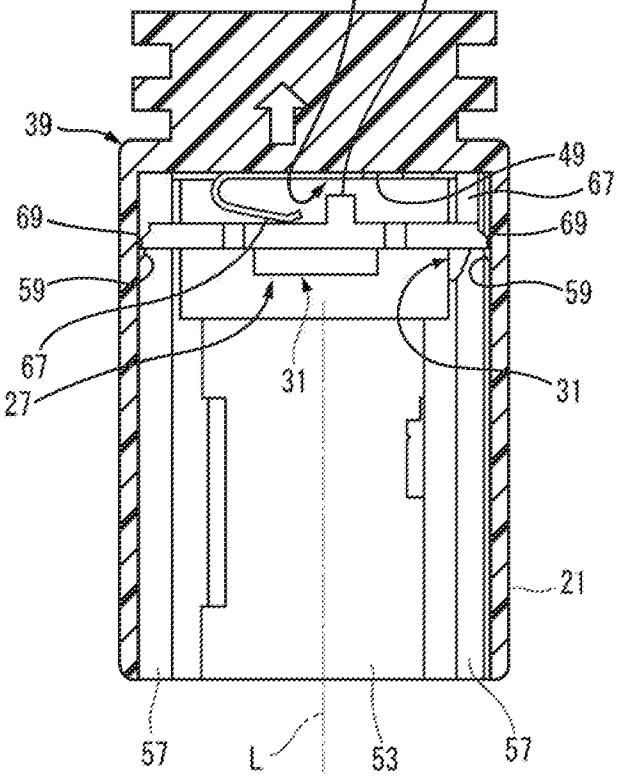
FIGS. 5A and 5B are plan sectional views of the connector shown in FIG. 1.
Figure 5A:
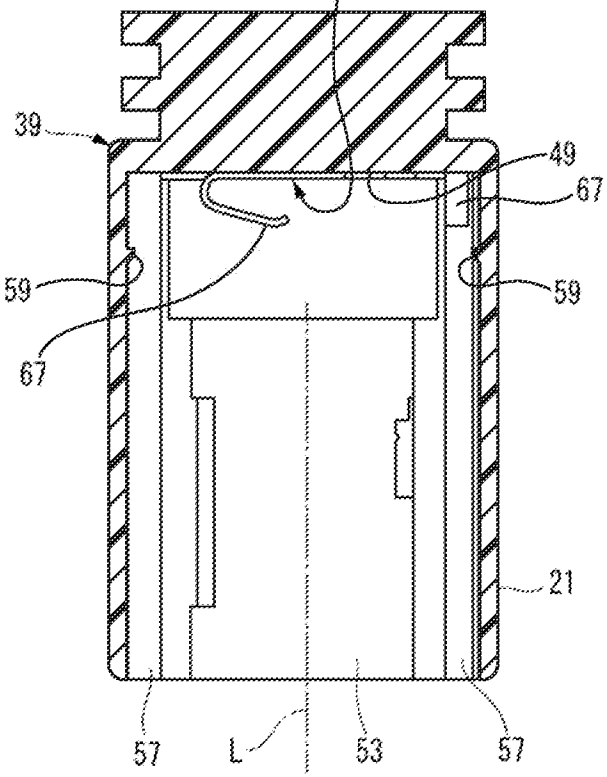

FIGS. 5A and 5B are plan sectional views of the connector 13 shown in FIG. 1. FIG. 5A is a plan sectional view of the hood 21 to which the plate spring member 25 is mounted. FIG. 5B is a plan sectional view of the hood 21 to which the plate spring member 25 and the playing regulating member 27 are mounted.

As shown in FIG. 5A, the plate spring member 25 is inserted into the fitting space 55 of the hood 21, and the press-fitting projections 65 are press-fitted into the respective press-fitting holes 61, so that the plate spring main body portion 63 is fixed and in close contact with the bottom 49 in parallel.

As shown in FIG. 5B, the playing regulating member 27 is inserted into the fitting space 55 in the hood 21 in which the plate spring member 25 is fixed to the bottom 49. When the protruding portions 69 are respectively engaged with the locked protruding portions 59 of the grooves 57, the playing regulating member 27 is regulated from falling-off from the hood 21, and the mounting is completed. In this engaged state, the spring portion 67 is in a state of being bent by a predetermined amount in advance in an arrow direction shown in FIG. 5B.

When the spring portion 67 is deformed by the predetermined amount in a mounting completed state of the playing regulating member 27 shown in FIG. 5B, the spring excessive displacement preventing projection 73 provided in the playing regulating member 27 abuts against the bottom 49. As a result, the spring excessive displacement preventing projection 73 prevents the spring portion 67 from being deformed excessively beyond an elastic limit and plastically deformed.

Figure 6:
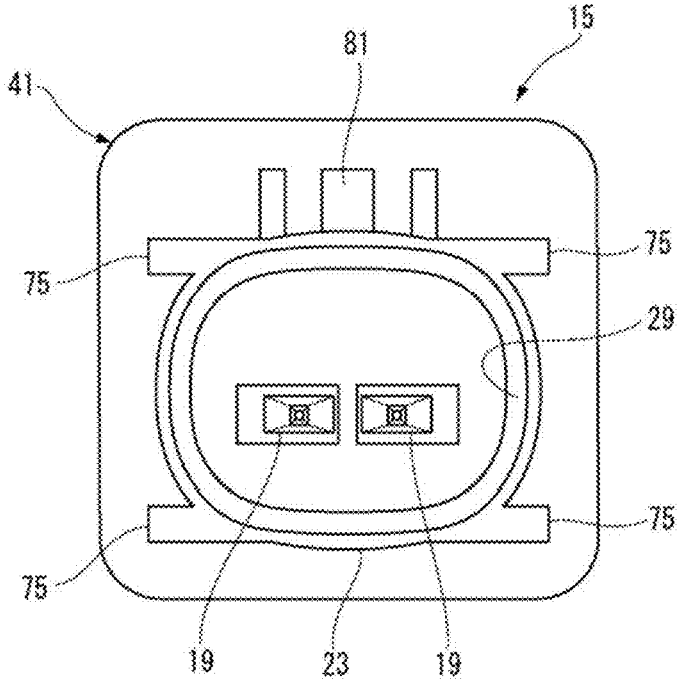
FIG. 6 is a front view of a mating connector shown in FIG. 1.

FIG. 6 is a front view of the mating connector 15 shown in FIG. 1.

The mating hood 23 fitted inside the hood 21 is integrally formed with the mating housing 41 of the mating connector 15. The inner tube portion 53 of the connector 13 is fitted inside the mating hood 23. The pair of mating terminals 19 that enters the terminal receiving ports 51 protrudes inside the mating hood 23. On both sides of an upper side portion and both sides of a lower side portion of the mating hood 23, ribs 75 protruding in extending directions of each side portion are formed. The ribs 75 are inserted into the respective grooves 57 of the hood 21 and serve as a fitting guide. The mating hood tip end inclined surface 29 is formed at a tip end at the fitting direction (Z direction) of the mating hood 23. Immediately before the completion of the fitting, the mating hood tip end inclined surface 29 abuts against the playing regulating member 27.

In the first embodiment, the mating hood tip end inclined surface 29 is inclined toward the tube inner side. That is, the mating hood tip end inclined surface 29 is formed as an inclined surface facing the tube inner side. The mating hood tip end inclined surface 29 may be formed around the entire inner periphery of the tip end of the mating hood 23, or may be formed only on portions corresponding to each of the regulating member inclined surfaces 71. In the first embodiment, the mating hood tip end inclined surface 29 is formed around the entire inner periphery at the tip end of the mating hood 23. The mating hood tip end inclined surfaces 29 abuts against the regulating member inclined surfaces 71 respectively in parallel.

The packing 33 is accommodated in the fitting space 55 of the hood 21. The packing 33 is formed in an annular shape by rubber or the like. The packing 33 is mounted on an outer periphery of the inner tube portion 53 to seal the inner tube portion 53 and the mating hood 23 in a watertight manner.

The electric wires 37 are respectively electrically connected to the terminals 17 by crimping or the like. The annular rubber plugs 35 are mounted to outer peripheries of the electric wires 37 connected to the terminals 17, respectively. The rubber plug 35 seals between the electric wire 37 and an electric wire outlet port 77 (see FIG. 7) of the housing 39 from which the electric wire 37 is led out. The rubber plug 35 is fixed to the electric wire 37 by, for example, being crimped to a crimping piece of the terminal 17.

The lock arm 43 of the connector 13 is formed in a cantilever shape in which a base end thereof is formed integrally with the housing 39 and the other end thereof extending forward is a free end. The lock arm 43 has an operation arm 44 extending rearward from a free end side. A rear end side of the operation arm 44 serves as an operation portion. The lock arm 43 includes an arm tip end portion 79 that faces the mating hood 23 of the mating connector 15. The arm tip end portion 79 is engaged with the lock projection 47 formed on the mating hood 23. The lock arm 43 and the lock projection 47 form a lock mechanism that fits and locks the connector 13 and the mating connector 15.

The side spacer 45 is inserted into a terminal accommodating chamber from one side surface of the housing 39. By inserting a regulating portion 46 into the terminal accommodating chamber, the side spacer 45 locks a rear end of the terminal 17 to regulate the terminal 17 from coming-off.

Next, a fitting operation of the connector structure according to the first embodiment will be described.

Figure 7:
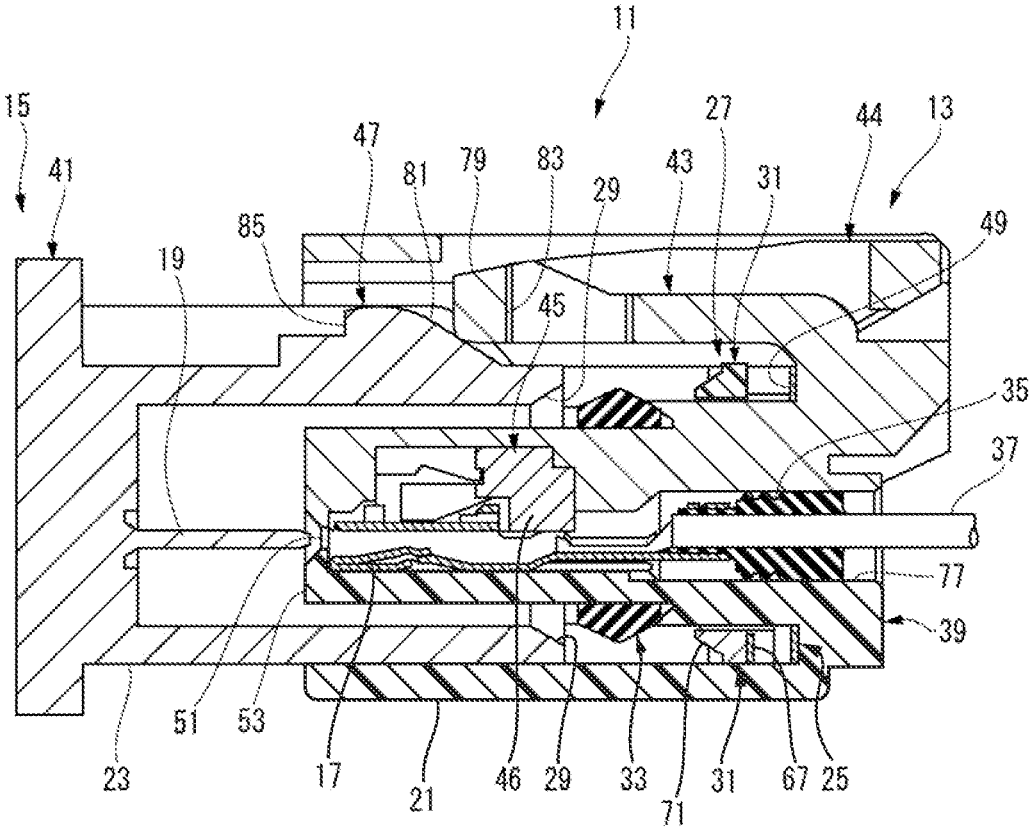
FIG. 7 is a longitudinal sectional view of the high vibration resistant connector in which contact between a lock arm and a lock projection is started.

FIG. 7 is a longitudinal sectional view of the high vibration resistant connector 11 in which contact between the lock arm 43 and the lock projection 47 is started.

In the connector structure according to the first embodiment, when fitting of the high vibration resistant connector 11 is started, as shown in FIG. 7, the lock arm 43 and the lock projection 47 start to contact each other. That is, the arm tip end portion 79 of the lock arm 43 comes into contact with an arm push-up inclined surface 81 of the lock projection 47. At this time, the lock insertion load is generated.

Figure 8:
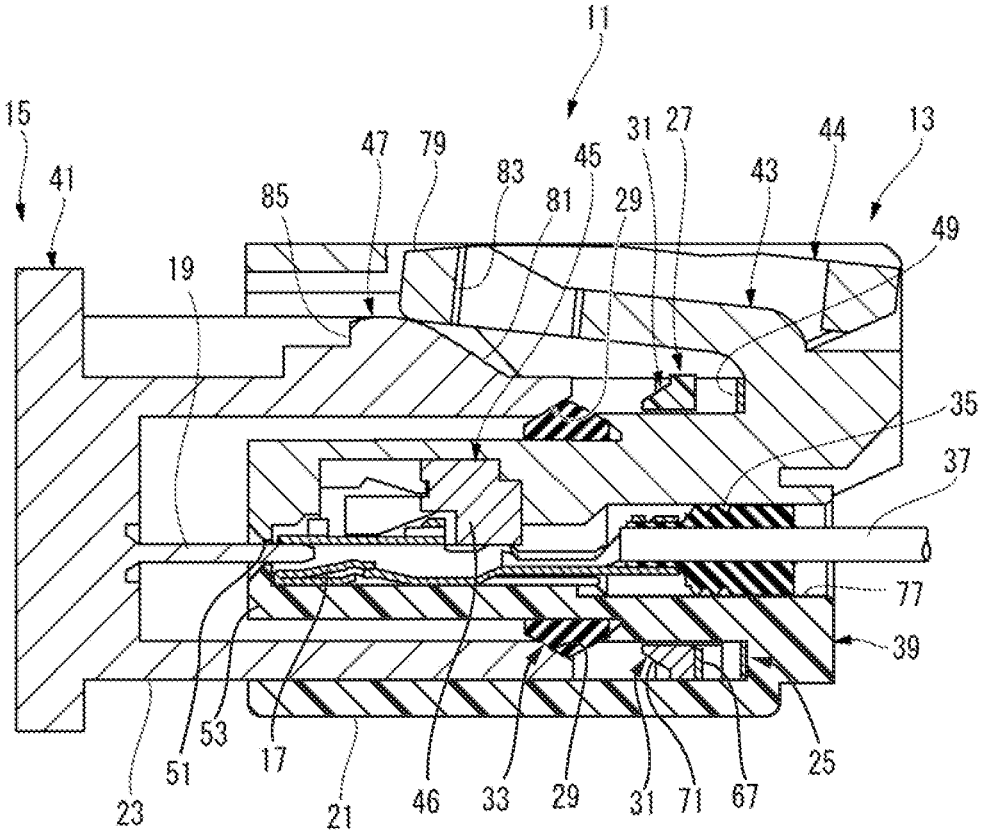
FIG. 8 is a longitudinal sectional view of the high vibration resistant connector in which a packing is started to be contacted.

FIG. 8 is a longitudinal sectional view of the high vibration resistant connector 11 in which the packing 33 is started to be contacted.

In a process of inserting the mating hood 23 into the fitting space 55 of the hood 21, as shown in FIG. 8, the packing 33 starts to enter the mating hood 23. At this time, the packing insertion load is generated. The arm tip end portion 79 goes above the arm push-up inclined surface 81.

Figure 9:
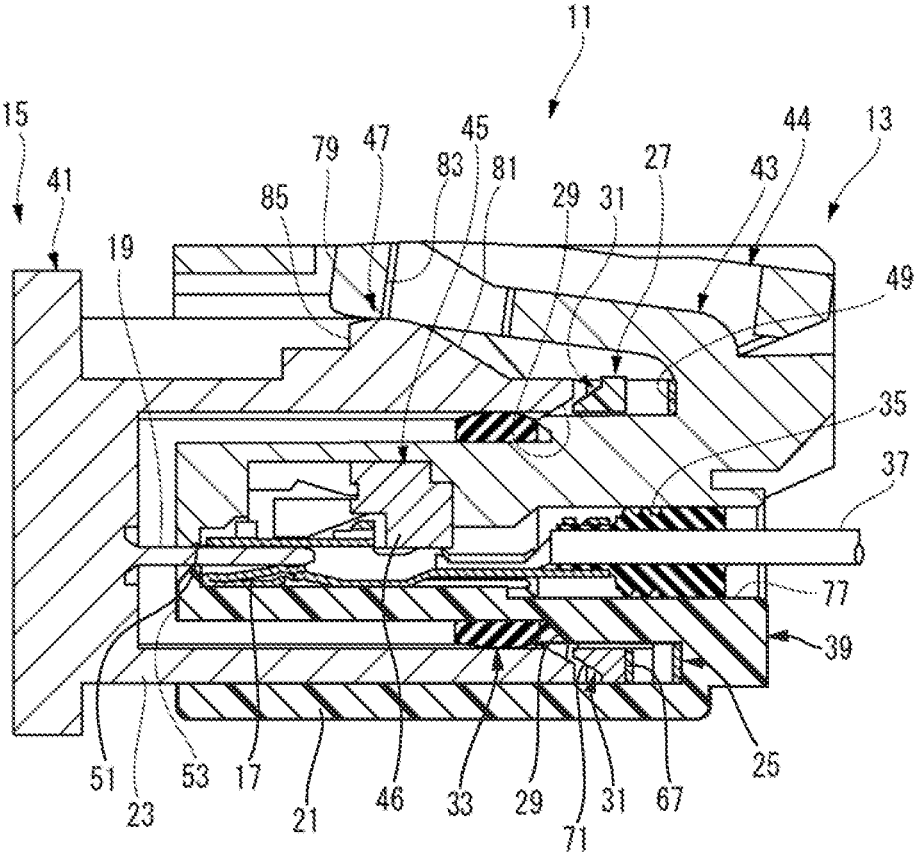
FIG. 9 is a longitudinal sectional view of the high vibration resistant connector in which contact between a terminal and a mating terminal is started.

FIG. 9 is a longitudinal sectional view of the high vibration resistant connector 11 in which contact between the terminal 17 and the mating terminal 19 is started.

Further, when the mating hood 23 is inserted into the hood 21, as shown in FIG. 9, the terminal 17 and the mating terminal 19 start to contact each other. At this time, the terminal insertion load is generated. At a later time point, the connector insertion force becomes the maximum.

Figure 10:
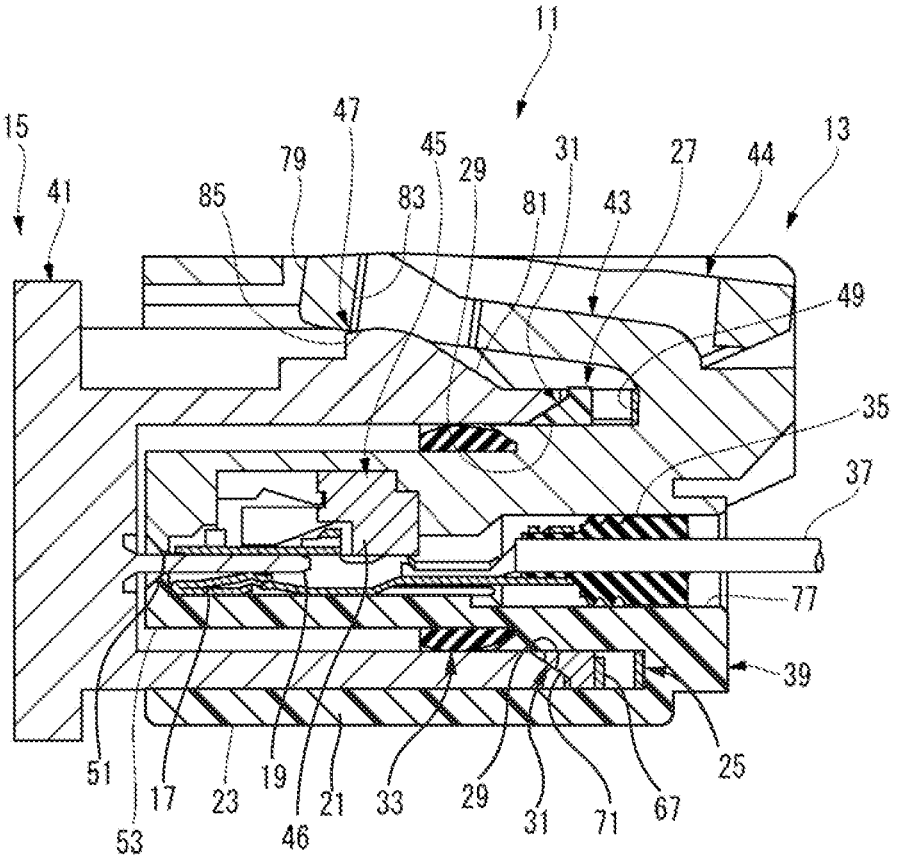
FIG. 10 is a longitudinal sectional view of the high vibration resistant connector in which contact between a mating hood and the playing regulating member is started.

FIG. 10 is a longitudinal sectional view of the high vibration resistant connector 11 in which contact between the mating hood 23 and the playing regulating member 27 is started.

Further, when the mating hood 23 is inserted into the hood 21, as shown in FIG. 10, the mating hood tip end inclined surface 29 of the mating hood 23 abuts against the regulating member inclined surface 71 of the playing regulating protrusion 31, and the pressing of the plate spring member 25 is started.

Figure 11:
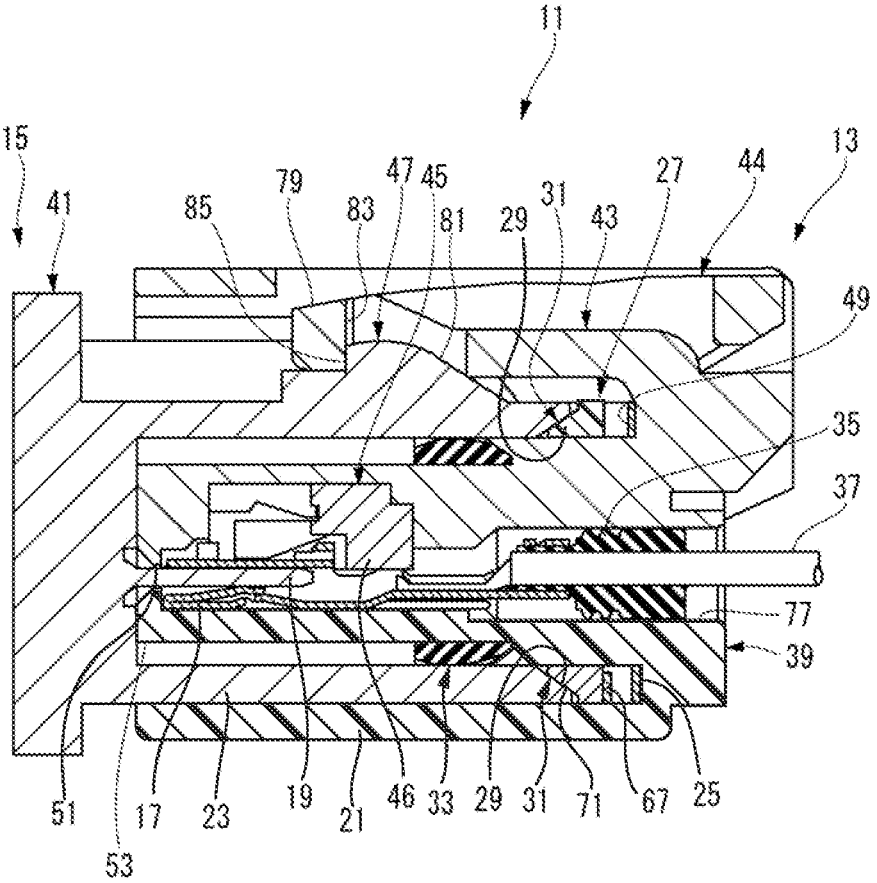
FIG. 11 is a longitudinal sectional view of the high vibration resistant connector in which fitting is completed.
Figure 12:
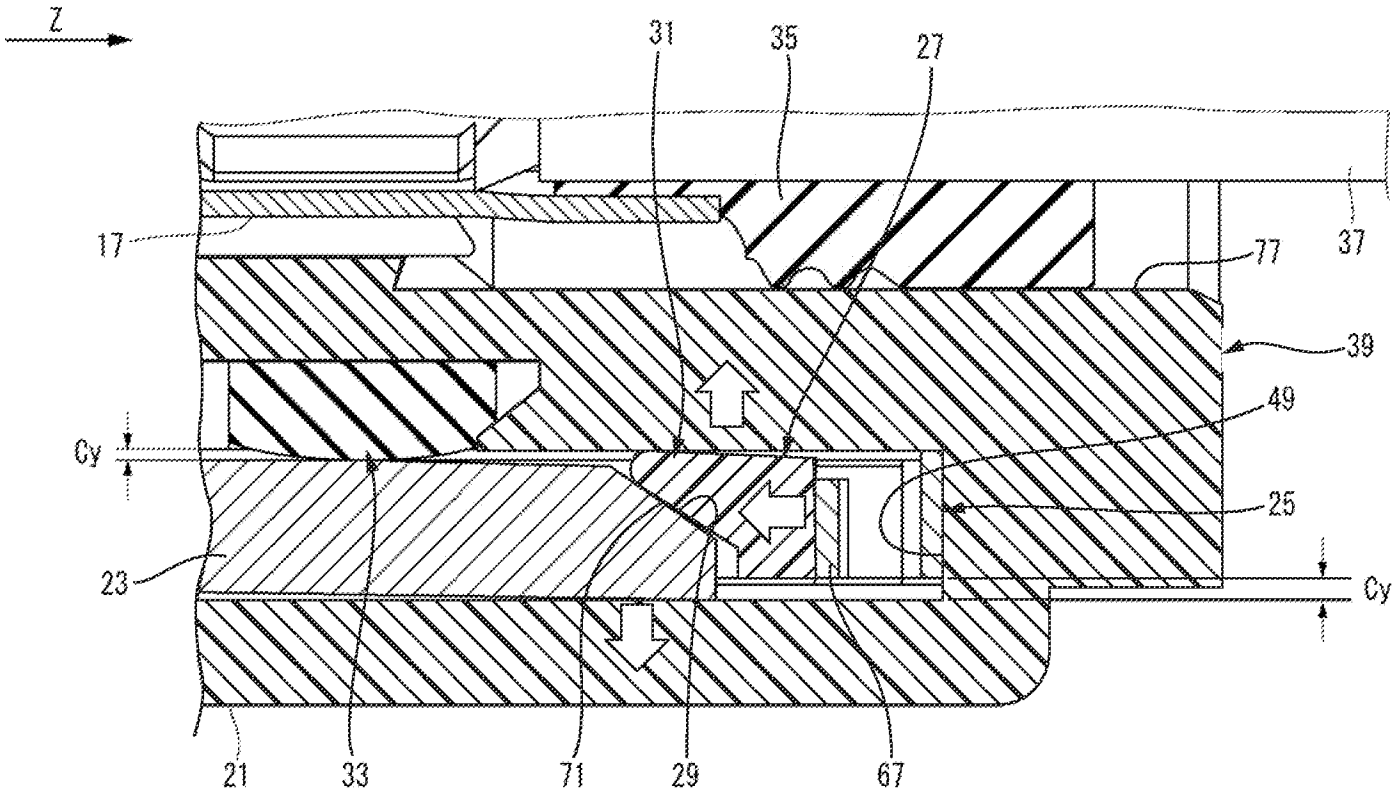
FIG. 12 is an enlarged view of a main part in FIG. 11.

FIG. 11 is a longitudinal sectional view of the high vibration resistant connector 11 in which fitting is completed, and FIG. 12 is an enlarged view of a main part of FIG. 11.

When the mating hood 23 is further inserted into the hood 21, as shown in FIG. 11, the spring portion 67 of the plate spring member 25 is pressed by the playing regulating member 27 to be elastically deformed, and an elastic repulsive force is generated in the spring portion 67. In the connector structure according to the first embodiment, an arm side locking surface 83 of the lock arm 43 and a mating locking surface 85 of the lock projection 47 are locked to complete the fitting.

As described above, in the connector structure according to the first embodiment, an abutting start position between the mating hood tip end inclined surface 29 (see FIG. 6) and the regulating member inclined surface 71 is set to a predetermined stroke position after a fitting force between the housing 39 and the mating housing 41 reaches the maximum. As a result, the connector structure according to the first embodiment is configured such that generation of the spring load does not increase the connector insertion force.

According to the connector structure of the first embodiment, in a fitted state of the high vibration resistant connector 11, the lock projection 47 and the lock arm 43 are engaged with each other, and an abutting state between the mating hood tip end inclined surface 29 and the regulating member inclined surface 71 of the playing regulating protrusion 31 is maintained.

Next, an action of the connector structure according to the first embodiment will be described.

In the connector structure according to the first embodiment, the connector 13 and the mating connector 15 are fitted and locked by the lock mechanism configured with the lock arm 43 and the lock projection 47, so that the fitting therebetween is regulated from being released. The connector structure according to the first embodiment is in a locked state in which the release of the fitting is regulated during use. The lock arm 43 is provided on the connector 13, and the lock projection 47 is provided on the mating connector 15, for example. Either of the lock arm 43 or the lock projection 47 configuring the lock mechanism may be provided on the connector 13 or the mating connector 15 as long as the lock arm 43 and the lock projection 47 relatively approach each other at the time of fitting.

The lock arm 43 provided in the connector 13 has the arm side locking surface 83 perpendicular to the fitting direction in a direction opposite to the fitting direction of the mating connector 15. Since the arm side locking surface 83 is disposed on the free end side of the lock arm 43, the arm side locking surface 83 can be displaced in a direction substantially perpendicular to the fitting direction of the mating connector 15. On the other hand, the lock projection 47 of the mating connector 15 is provided with the arm push-up inclined surface 81 having a downward slope that gradually decreases in the fitting direction (Z direction). That is, the arm push-up inclined surface 81 is an inclined surface gradually increasing toward the direction opposite side to the fitting direction (Z direction). The arm push-up inclined surface 81 is formed with the mating locking surface 85 that hangs substantially vertically at a top portion of a terminal end thereof that gradually increases.

When the connector 13 and the mating connector 15 are fitted, the lock arm 43 and the lock projection 47 approach each other. When the fitting is started, the arm push-up inclined surface 81 formed on the lock projection 47 abuts against the arm tip end portion 79 on which the arm side locking surface 83 is formed. When the fitting further proceeds, the arm tip end portion 79 is pushed up by the arm push-up inclined surface 81. That is, the arm tip end portion 79 goes above the arm push-up inclined surface 81. Immediately before the completion of the fitting, the arm tip end portion 79 reaches the top portion of the arm push-up inclined surface 81. In this state, the lock arm 43 is elastically deformed to the uppermost position.

Here, the arm tip end portion 79 needs to pass through the top portion of the arm push-up inclined surface 81. When the arm tip end portion 79 passes through the top portion of the arm push-up inclined surface 81, the lock arm 43 finishes riding on the arm push-up inclined surface 81. When the arm tip end portion 79 passes through the top portion, the lock arm 43 falls along the mating locking surface 85 due to an elastic restoring force. Accordingly, the mating locking surface 85 and the arm side locking surface 83 face each other, and the connector 13 and the mating connector 15 are regulated from being detached. That is, the connector 13 and the mating connector 15 are locked in the fitted state by the lock mechanism.

At this time, the arm tip end portion 79 must slightly pass through the top portion so as to fall along the mating locking surface 85. A slight passing distance is an essential clearance for completing the locking of the lock mechanism.

The clearance in the lock mechanism remains even when the connector 13 and the mating connector 15 are in the locked state. That is, even in the locked state of the connector, the lock arm 43 and the lock projection 47 can move slightly relative to each other by the clearance.

Therefore, the terminal 17 accommodated in the housing 39 and the mating terminal 19 accommodated in the mating housing 41 can be finely slid by the clearance due to vibration during traveling of a vehicle or the like. When the fine sliding between the terminal 17 and the mating terminal 19 occurs over a long period of time, wear (that is, fine sliding wear) exceeds an allowable amount, and the electrical connection reliability may be reduced.

Therefore, in the connector structure according to the first embodiment, the plate spring member 25 made of metal is provided at the bottom 49 of the hood 21. The playing regulating member 27 is provided facing the bottom 49 with the plate spring member 25 interposed therebetween. The playing regulating member 27 is urged by the plate spring member 25 in the direction opposite to the fitting direction of the mating hood 23. The playing regulating member 27 is provided with the regulating member inclined surface 71. Immediately before the completion of the fitting, the regulating member inclined surface 71 is pressed against the mating hood tip end inclined surface 29 formed at the tip end in the fitting direction of the mating hood 23. The playing regulating member 27 including the regulating member inclined surface 71 pressed against the mating hood tip end inclined surface 29 compresses and deforms the spring portion 67 of the plate spring member 25 against a spring force (elastic restoring force).

As described above, the tip end portion 79 that has reached the top portion of the arm push-up inclined surface 81 passes through the top portion by the clearance and locks the arm side locking surface 83 to the mating locking surface 85. Even in movement by the clearance, the plate spring member 25 is compressed to accumulate the elastic restoring force. Therefore, when an insertion force for the fitting is released, the mating housing 41 of the mating connector 15 is urged by the elastic restoring force of the plate spring member 25 and pushed back in the direction opposite to the fitting direction.

Therefore, in the mating housing 41 of the mating connector 15 pushed back by the elastic restoring force of the plate spring member 25, the mating locking surface 85 of the lock projection 47 provided on the mating housing 41 is brought into close contact with the arm side locking surface 83 of the lock arm 43 provided on the housing 39, and the clearance in the lock mechanism can be eliminated. That is, the rattling due to the clearance in the lock mechanism that fits and locks the housing 39 and the mating housing 41 is reduced. Accordingly, in the connector structure according to the first embodiment, in the fitted and locked state of the housing 39 and the mating housing 41, a movement between the mating locking surface 85 of the lock projection 47 and the arm side locking surface 83 of the lock arm 43 in approaching and separating directions due to the clearance in the lock mechanism becomes impossible. As a result, in the connector structure according to the first embodiment, even when the vibration occurs when the vehicle is traveling or the like, the fine sliding between the terminal 17 accommodated in the housing 39 and the mating terminal 19 accommodated in the mating housing 41 can be prevented.

In the connector structure according to the first embodiment, the plate spring member 25 that pushes back the mating housing 41 so as to eliminate the clearance in the lock mechanism is made of a metal elastic member. Therefore, the plate spring member 25 is less likely to creep due to aging like an elastic member made of rubber or resin. That is, a push-back force acting on the mating housing 41 can be maintained for a long period of time. Therefore, the plate spring member 25 can maintain the elastic repulsive force of the spring portion 67 even in long-term use, and can prevent the rattling in the fitting direction between the housing 39 and the mating housing 41.

In addition, the mating hood tip end inclined surface 29 of the mating hood 23 and the regulating member inclined surface 71 of the playing regulating protrusion 31 which are in the abutting state may displace in directions inward and outward the tube (X direction and Y direction) by receiving the elastic restoring force of the plate spring member 25.

In the first embodiment, the mating hood tip end inclined surface 29 facing the tube inner side is formed at the tip end of the mating hood 23, and the regulating member inclined surface 71 facing the tube outer side is provided on the playing regulating protrusion 31. In this case, by receiving the elastic restoring force of the plate spring member 25, the tip end of the mating hood 23 displaces toward the tube outer side, and the playing regulating protrusion 31 displaces toward the tube inner side.

The displacement prevents rattling in the upper-lower direction (Y direction) and the left-right direction (X direction) orthogonal to the tubular center axis L due to the clearance Cy between the housing 39 and the mating housing 41.

Therefore, according to the connector structure of the first embodiment, abrasion powder generated by the fine sliding wear between the terminal 17 and the mating terminal 19 can be prevented from being an oxide insulator, so that the contact reliability between the terminal 17 and the mating terminal 19 can be prevented from being reduced. Therefore, it is possible to maintain good contact reliability over a long period of time.

In the connector structure according to the first embodiment, the fitting space 55 is effectively used by accommodating the plate spring member 25 and the playing regulating member 27 in the fitting space 55 of the hood 21 into which the mating hood 23 is inserted. As a result, it is not necessary to ensure a dedicated rattling regulation space in other portions.

In the connector structure according to the first embodiment, at least four playing regulating protrusions 31 provided on the playing regulating member 27 are separately provided on four sides including upper and lower sides of the playing regulating member 27 that sandwich the tubular center axis L of the hood 21 vertically, and left and right sides of the playing regulating member 27 that sandwich the tubular center axis L of the hood 21 on the left and right. As described above, in the connector structure according to the first embodiment, the four playing regulating protrusion 31 provided on the playing regulating member 27 are arranged radially in four directions sandwiching the tubular center axis L in the upper-lower and left-right directions (Y. X directions).

The mating hood tip end inclined surface 29 of the mating connector 15 abuts against the playing regulating member 27 substantially uniformly in a radial direction (upper-lower and left-right directions) around the tubular center axis L. Accordingly, an urging force of the plate spring member 25 acting on the mating hood tip end inclined surface 29 via the playing regulating member 27 is substantially uniform in the radial direction around the tubular center axis L. As a result, the playing regulating member 27 can maintain a high degree of parallelism with the bottom 49 of the connector 13 even when the plate spring member 25 is pressed or moved, or when the mating hood 23 of the mating connector 15 is pushed back. Therefore, in the connector structure according to the first embodiment, it is possible to prevent the playing regulating member 27 from being inclined with respect to the bottom 49 and causing the rattling reducing action to be uneven in the radial direction.

In the connector structure according to the first embodiment, the playing regulating member 27 includes the spring excessive displacement preventing projection 73 protruding toward the bottom 49. When the connector 13 and the mating connector 15 are fitted, the regulating member inclined surface 71 is pressed against the mating hood tip end inclined surface 29, and the playing regulating member 27 presses the plate spring member 25 toward the bottom 49. The spring portion 67 provided on the plate spring member 25 is compressed and deformed by this pressing. In a process of compressing and deforming the spring portion 67 of the plate spring member 25, the spring excessive displacement preventing projection 73 abuts against the bottom 49 before displacement exceeding the elastic limit is applied.

Accordingly, the spring portion 67 of the plate spring member 25 is regulated from further displacement. As a result, according to the connector structure of the first embodiment, the spring portion 67 of the plate spring member 25 can be prevented from being excessively deformed beyond the elastic limit and plastically deformed, so that a stable rattling reducing action can be maintained.

Next, a connector structure according to a second embodiment of the present invention will be described.

Figure 13:
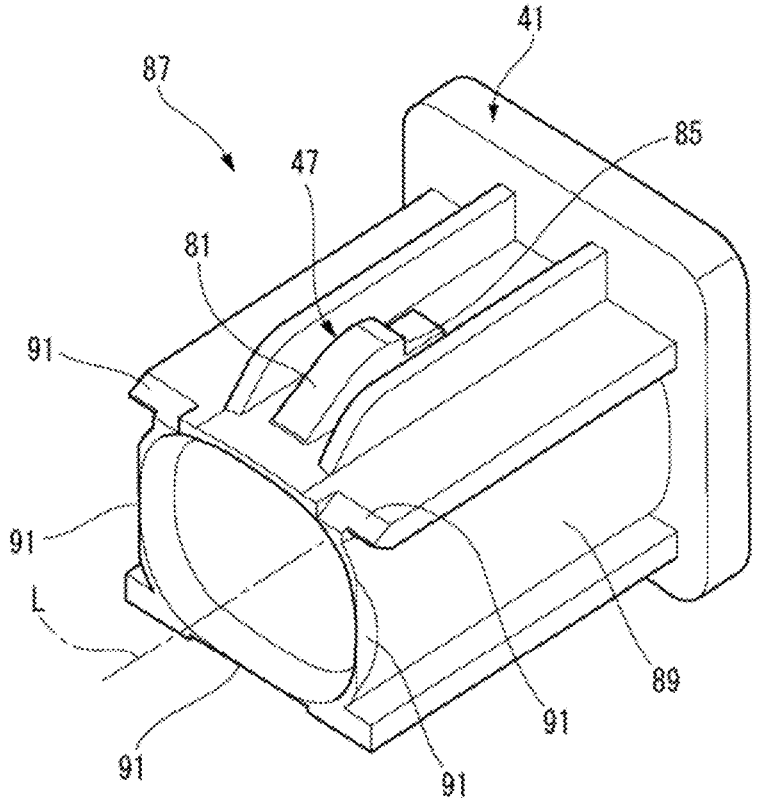
FIG. 13 is a perspective view of a mating connector in a high vibration resistant connector including a connector structure according to a second embodiment of the present invention.

FIG. 13 is a perspective view of a mating connector 87 in a high vibration resistant connector including a connector structure according to the second embodiment of the present invention.

In the connector structure according to the second embodiment, a mating hood tip end inclined surface 91 of a mating hood 89 in a mating housing 41 of a mating connector 87 is inclined to the tube outer side. That is, the mating hood tip end inclined surface 91 is formed as an inclined surface facing the tube outer side.

At least four mating hood tip end inclined surfaces 91 are separately provided on four sides including upper and lower sides of the mating hood 89 that sandwich the tubular center axis L of the hood 21 vertically, and left and right sides of the mating hood 89 that sandwich the tubular center axis L of the hood 21 on the left and right in the housing 39. In the second embodiment, a pair of mating hood tip end inclined surfaces 91 is provided on one of the four sides (upper side of the mating hood 89) with the tubular center axis L interposed therebetween. Therefore, the mating hood tip end inclined surfaces 91 of the second embodiment are radially arranged with a total of five.

Figure 14:
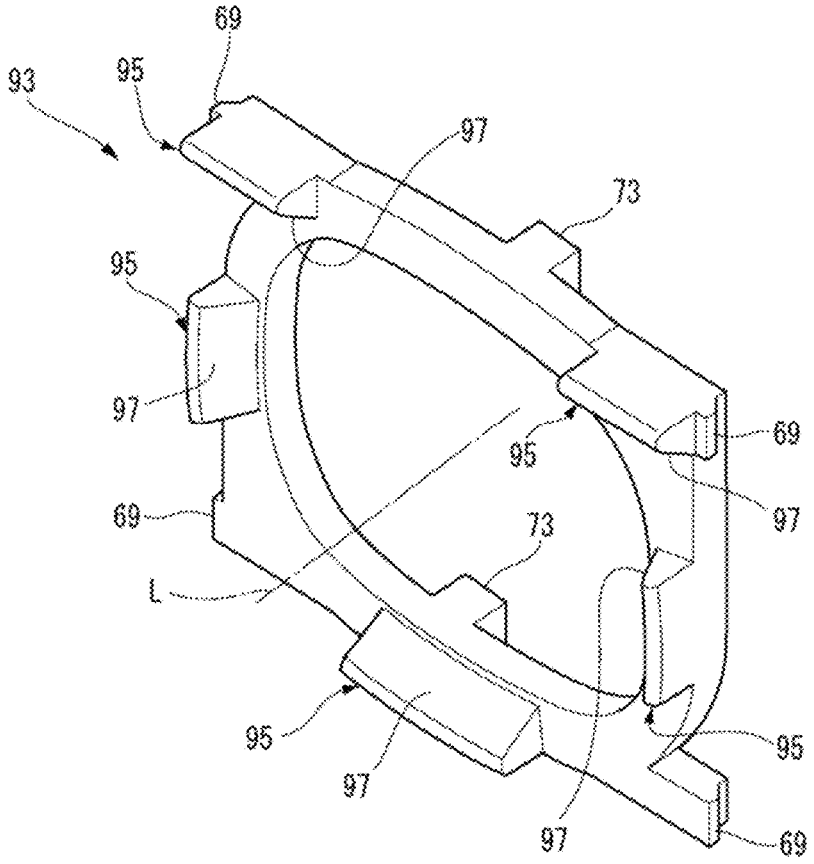
FIG. 14 is a perspective view of a playing regulating member according to the second embodiment of the present invention.

FIG. 14 is a perspective view of a playing regulating member 93 according to the second embodiment of the present invention.

In the connector structure according to the second embodiment, a regulating member inclined surface 97 of a playing regulating protrusion 95 in the playing regulating member 93 is inclined to the tube inner side. That is, the regulating member inclined surface 97 is formed as an inclined surface facing the tube inner side.

At least four playing regulating protrusions 95 provided with the regulating member inclined surface 97 are separately provided on four sides including upper and lower sides of the playing regulating member 93 that sandwich the tubular center axis L of the hood 21 vertically, and left and right sides of the playing regulating member 93 that sandwich the tubular center axis L of the hood 21 on the left and right in the housing 39. In the second embodiment, a pair of playing regulating protrusions 95 of the playing regulating member 93 is provided on one of the four sides (upper side of the playing regulating member 93) with the tubular center axis L interposed therebetween. Therefore, the playing regulating protrusions 95 of the second embodiment are radially arranged with a total of five.

Accordingly, the regulating member inclined surface 97 of the playing regulating protrusion 95 and the mating hood tip end inclined surface 91 of the mating hood 89 are configured to face each other respectively. The mating hood tip end inclined surfaces 91 abut against the regulating member inclined surfaces 97 respectively in parallel. Other configurations are the same as those of the connector structure according to the first embodiment.

Figure 15:
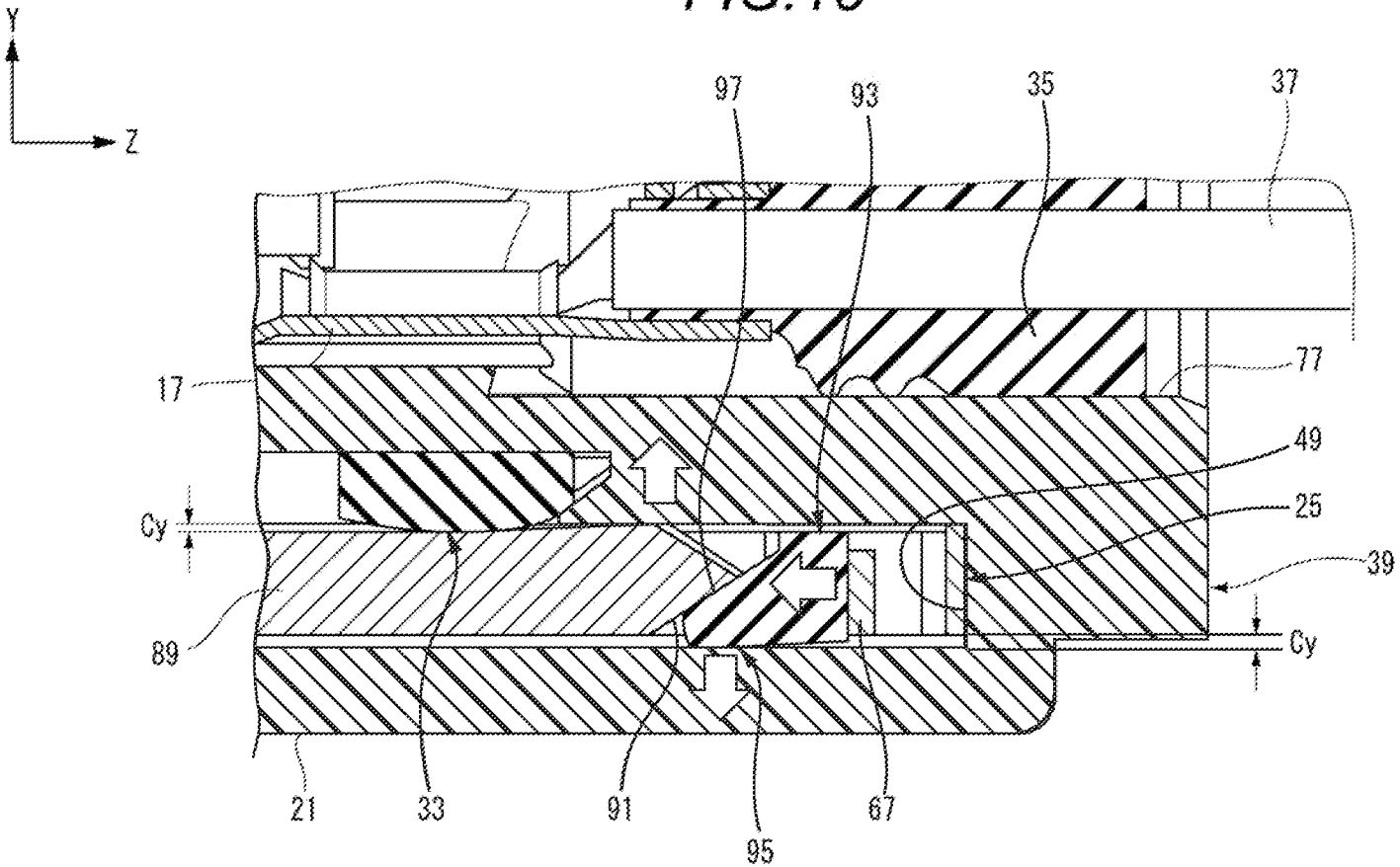
FIG. 15 is an operation explanatory view showing a rattling reducing action by a mating hood tip end inclined surface and a regulating member inclined surface in the high vibration resistant connector according to the second embodiment of the present invention.
Figure 16:
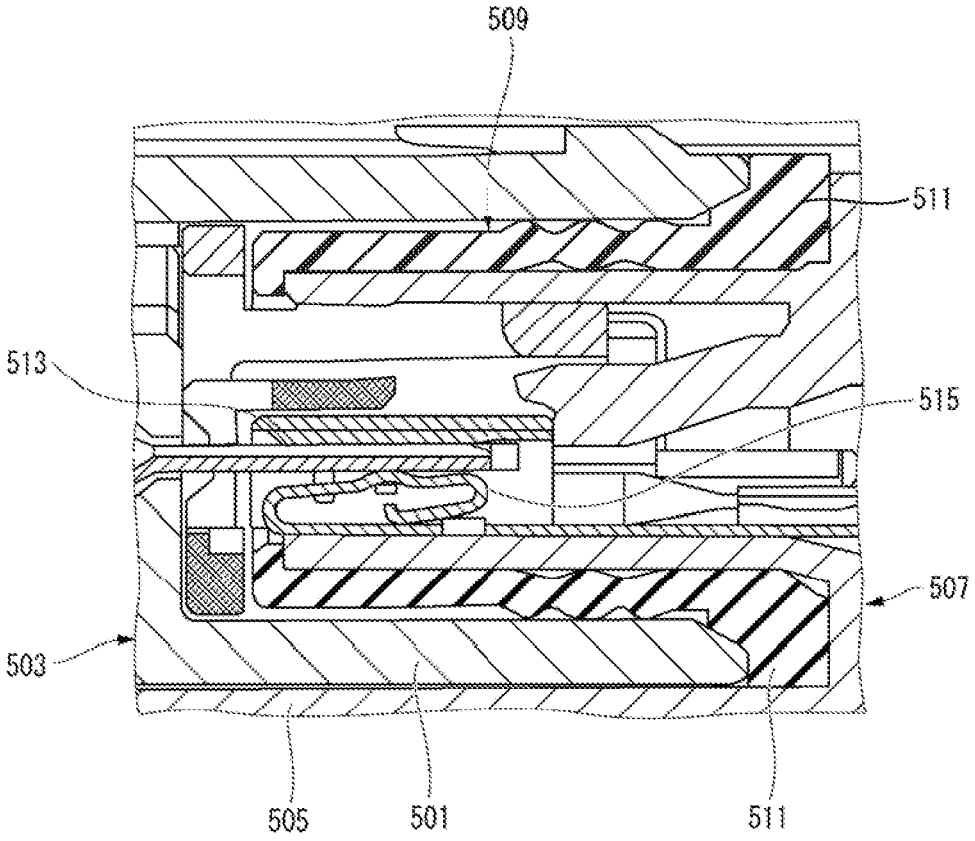
FIG. 16 PRIOR ART
FIG. 16 is a longitudinal sectional view of a connector having a connector structure in related art.

FIG. 15 is an operation explanatory view showing a rattling reducing action by the mating hood tip end inclined surface 91 and the regulating member inclined surface 97.

In the connector structure according to the second embodiment, the mating hood tip end inclined surface 91 facing the tube outer side is formed at a tip end of the mating hood 89 in the mating housing 41, and the regulating member inclined surface 97 facing the tube inner side is provided on the playing regulating protrusion 95 of the playing regulating member 93. In this case, by receiving the elastic restoring force of the plate spring member 25, the tip end of the mating hood 89 displaces toward the tube inner side, and the playing regulating protrusion 95 displaces toward the tube outer side.

The displacement prevents rattling in the upper-lower direction and the left-right direction (X direction and Y direction) orthogonal to the tubular center axis L due to the clearance Cy between the hood 21 of the housing 39 and the mating hood 89 of the mating housing 41.

Therefore, according to the connector structure of the second embodiment, abrasion powder generated by the fine sliding wear between the terminal 17 and the mating terminal 19 can be prevented from being an oxide insulator, so that the contact reliability between the terminal 17 and the mating terminal 19 can be prevented from being reduced. Therefore, it is possible to maintain good contact reliability over a long period of time.

In addition, in the connector structure according to the second embodiment, the tip end of the mating hood 89 displaces to the tube inner side. The mating hood 89 displaced to the tube inner side displaces in a direction approaching the packing 33. Therefore, according to the connector structure of the second embodiment, the mating hood 89 is in closer contact with the packing 33, so that the watertight sealing performance can be improved.

Therefore, according to the connector structure according to the above-described embodiments, a stable vibration resistant effect can be obtained even after aging.

The present invention is not limited to the embodiments described above, and may be appropriately modified, improved or the like. In addition, the material, shape, size, number, arrangement position, or the like of each component in the above-described embodiments are optional and are not limited as long as the present invention can be achieved.

Here, characteristics of the embodiments of the connector structure according to the present invention above will be briefly summarized in the following [1] to [3], respectively.

[1] A connector structure comprising:

a hood (21) formed in a housing (39) and having a bottomed tubular shape;

a mating hood (23, 89) formed in a mating housing (41) and fitted inside the hood;

a plate spring member (25) made of metal and accommodated in the bottom (49) of the hood;

a playing regulating member (27, 93);

a mating hood tip end inclined surface (29, 91) formed at a tip end of the mating hood in a fitting direction and inclined to a tube inner side or a tube outer side; and a playing regulating protrusion (31, 95), wherein the playing regulating member (27, 93) is provided in an opposite side against the bottom with the plate spring member interposed therebetween and is urged by the plate spring member in a direction opposite to a fitting direction (Z direction) against the mating hood, and wherein the playing regulating protrusion (31, 95) is provided on the playing regulating member and has a regulating member inclined surface (71, 97) which is configured to be abutted against the mating hood tip end inclined surface in a state that the housing and the mating housing are fitted with each other.

[2] The connector structure according to [1], wherein at least one of the playing regulating protrusion (31, 95) is provided on each of the playing regulating member (27, 93) in an upper-lower direction (Y direction) and a left-right direction (X direction) that are orthogonal to each other, and is orthogonal to a tubular center axis (L) of the hood (21).

[3] The connector structure according to [1] or [2], wherein a spring excessive displacement preventing projection (73) that abuts against the bottom (49) is formed on the playing regulating member (27, 93).

DESCRIPTION OF REFERENCE NUMERALS AND SIGNS

11 high vibration resistant connector
21 hood
23 mating hood
25 plate spring member
27 playing regulating member
29 mating hood tip end inclined surface
31 playing regulating protrusion
39 housing
41 mating housing
49 bottom
71 regulating member inclined surface
73 spring excessive displacement preventing projection
89 mating hood
91 mating hood tip end inclined surface
93 playing regulating member

95 playing regulating protrusion
97 regulating member inclined surface

What is claimed is:

1. A connector structure comprising:

a hood formed in a housing and having a bottomed tubular shape;

a mating hood formed in a mating housing and fitted inside the hood;

a plate spring member made of metal and accommodated in a bottom of the hood;

a playing regulating member;

a mating hood tip end inclined surface formed at a tip end of the mating hood in a fitting direction and inclined to a tube inner side or a tube outer side; and at least one playing regulating protrusion, wherein the playing regulating member is provided in an opposite side against the bottom with the plate spring member interposed therebetween and is urged by the plate spring member in a direction opposite to a fitting direction against the mating hood, and wherein the at least one playing regulating protrusion is provided on the playing regulating member and has a regulating member inclined surface which is configured to be abutted against the mating hood tip end inclined surface in a state that the housing and the mating housing are fitted with each other.

2. The connector structure according to claim 1, wherein the at least one playing regulating protrusion is provided on the playing regulating member in an upper-lower direction and a left-right direction that are orthogonal to each other, and the at least one playing regulating protrusion is orthogonal to a tubular center axis of the hood.

3. The connector structure according to claim 1, wherein a spring excessive displacement preventing projection that abuts against the bottom is formed on the playing regulating member.

* * * * *